United States Patent [19]

Hawkins

[11] 4,077,362

[45] Mar. 7, 1978

[54] STEAM-WATER SEPARATOR ARRANGEMENT

[75] Inventor: Ronald James Hawkins, Morden, England

[73] Assignee: Babcock & Wilcox, Limited, London, Great Britain

[21] Appl. No.: 722,836

[22] Filed: Sep. 13, 1976

[51] Int. Cl.[2] ..... F22B 37/26; B01D 45/12

[52] U.S. Cl. ..... 122/491; 55/349; 55/459 R; 55/DIG. 23

[58] Field of Search ..... 122/34, 488, 491; 55/346, 347, 348, 349, 459 R, DIG. 23

[56] References Cited

U.S. PATENT DOCUMENTS

| | | | |
|---|---|---|---|
| 2,763,245 | 9/1956 | Place | 122/488 |
| 3,296,779 | 1/1967 | Daman et al. | 122/34 |
| 3,324,634 | 6/1967 | Brahler et al. | 122/34 |
| 3,507,099 | 4/1970 | Marshall | 122/488 |

*Primary Examiner*—Kenneth W. Sprague
*Attorney, Agent, or Firm*—J. Maguire; R. J. Edwards

[57] ABSTRACT

A steam and water drum internal arrangement which provides free access to the drum inner wall and facilitates the removal of the steam and water separators from within the drum by mounting the separators on a duct which extends centrally of the drum and communicates with extension conduits to receive a steam and water mixture from the steam generating tubes.

5 Claims, 2 Drawing Figures

STEAM-WATER SEPARATOR ARRANGEMENT

BACKGROUND OF THE INVENTION

The present invention relates to vapor generation, and more particularly to improvements in the internal arrangement of steam and water drums.

Hitherto, the steam and water separators have been mounted on curved plates which form a collecting chamber adjacent the drum wall to receive a steam and water mixture from the steam generating tubes for flow to the steam and water separators. This prior art arrangement has the disadvantage of requiring the removal of the steam and water separators and the curved plates to provide access for inspection of the portion of the drum wall which faces the collecting chamber.

SUMMARY OF THE INVENTION

The present invention discloses a steam and water drum internal arrangement which provides free access to the drum inner wall by centrally locating the steam and water separators and dispensing with the need for a drum wall associated collecting chamber. Moreover, should maintenance requirements necessitate removal of the steam and water separators from within the drum, the separators as well as the supporting duct may be easily taken out through an appropriately sized opening formed at one end of the drum.

Accordingly, there is provided a stream and water and drum internal arrangement which includes steam and water separators mounted on a duct which extends centrally of the drum and communicates with conduit means to receive a stream and water mixture from the steam generating tubes.

DESCRIPTION OF THE PREFERRED EMBODIMENTS

Figure 1:
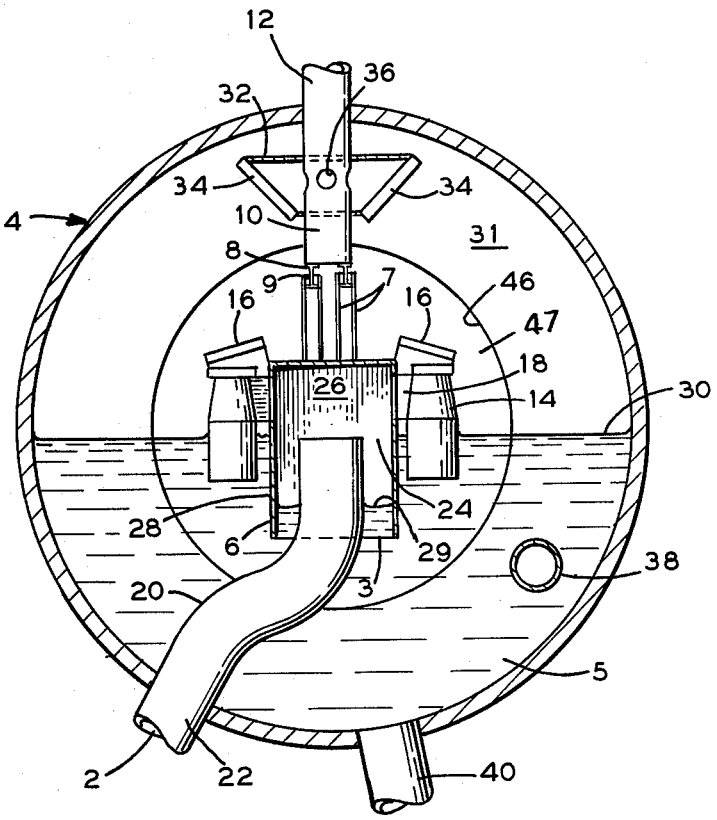
FIG. 1 is a diametric cross sectional elevation through a horizontally extending cylindrical steam and water drum embodying the invention.

Referring to FIG. 1, a steam generator (not shown) includes steam generating tubes, of the like shown at 2, which discharge to a horizontally extending steam and water drum 4. The drum is provided with a centrally locaed axial duct 6 formed in the shape of a trough and having an open bottom 3 immersed in the water space 5. The duct 6 is end supported from a pair of axially extending beams 8 through corresponding pairs of stradding hanger plates 7, the latter being provided with rollers 9 which are supportingly and slidably engaged with the lower flanges of beams 8. The beams 8 are secured to extension conduits, of the like shown at 10, which are in turn connected to steam outlet tubes of the like shown at 12, the latter being disposed at spaced intervals along the length of the drum. Cyclone type steam and water separators 14 and primary steam driers or scrubbers 16 are mounted on both sides of the axial duct 6 with the cyclone separators 14 havin their tangential inlets 18 communicating with the interior 26 of duct 6. The drum inlets, of the like shown at 22, which receive the steam generating tubes, of the like shown at 2, are connected through extension conduits 20 with an upper portion 24 of the interior 26 of duct 6. In accordance with the invention, the side walls 28 of duct 6 extend downwardly below the minimum drum water level datum 30 by a vertical distance greater than the difference between the water level 29 within the duct 6 and the water level 30 externally of the duct 6 resulting from the maximum pressure drop through the cyclone separators 14, so that a water seal is effected.

The steam space 31 houses a duct 32 having a trapezoidal cross section and which is mounted onto the extension conduits, of the like shown at 10, and includes secondary steam driers or scurbbers 34 extending over the length of the drum 4. The extension conduits, of the like shown at 10, are provided with radial openings 36 communicating with the interior of duct 32 to allow dried steam to pass through the extension conduits for discharge through steam outlet tubes, of the like shown at 12. Feedwater is supplied to the drum 4 through a longitudinally extending feed pipe 38 and water is conveyed to the generating section (not shown) through downcomers, of the like shown at 40.

Removal of the duct 6, the cyclone separators 14 and the primary steam driers 16 is effected by removing the drum end cover plate 46 and is facilitated by providing an opening 47 which has been sized to allow passage therethrough of the assembled unit consisting of the duct 6, the cyclone separators 14 and the primary steam driers 16. Removal of the assembled unit is further facilitated by the rollers 9 which allow it to be rolled along the lower flanges of beams 8 during the removal procedure.

During operation, the steam and water mixture being discharged through the generating tubes, of the like shown at 2, is conveyed through the extension conduits, of the like shown at 20, to the axial duct 6 and through the cyclone separators 14 wherein the steam and water are separated with the steam being discharged through the primary steam driers 16 to the steam space 31 and thence through the secondary steam driers 34 and through the duct 32 and the extension conduits, of the like shown at 10, to the steam outlets, of the like shown at 12. The water leaving the cyclone separators 14 is discharged to the water space 5 to be recirculated through the downcomers, of the like shown at 40.

Figure 2:
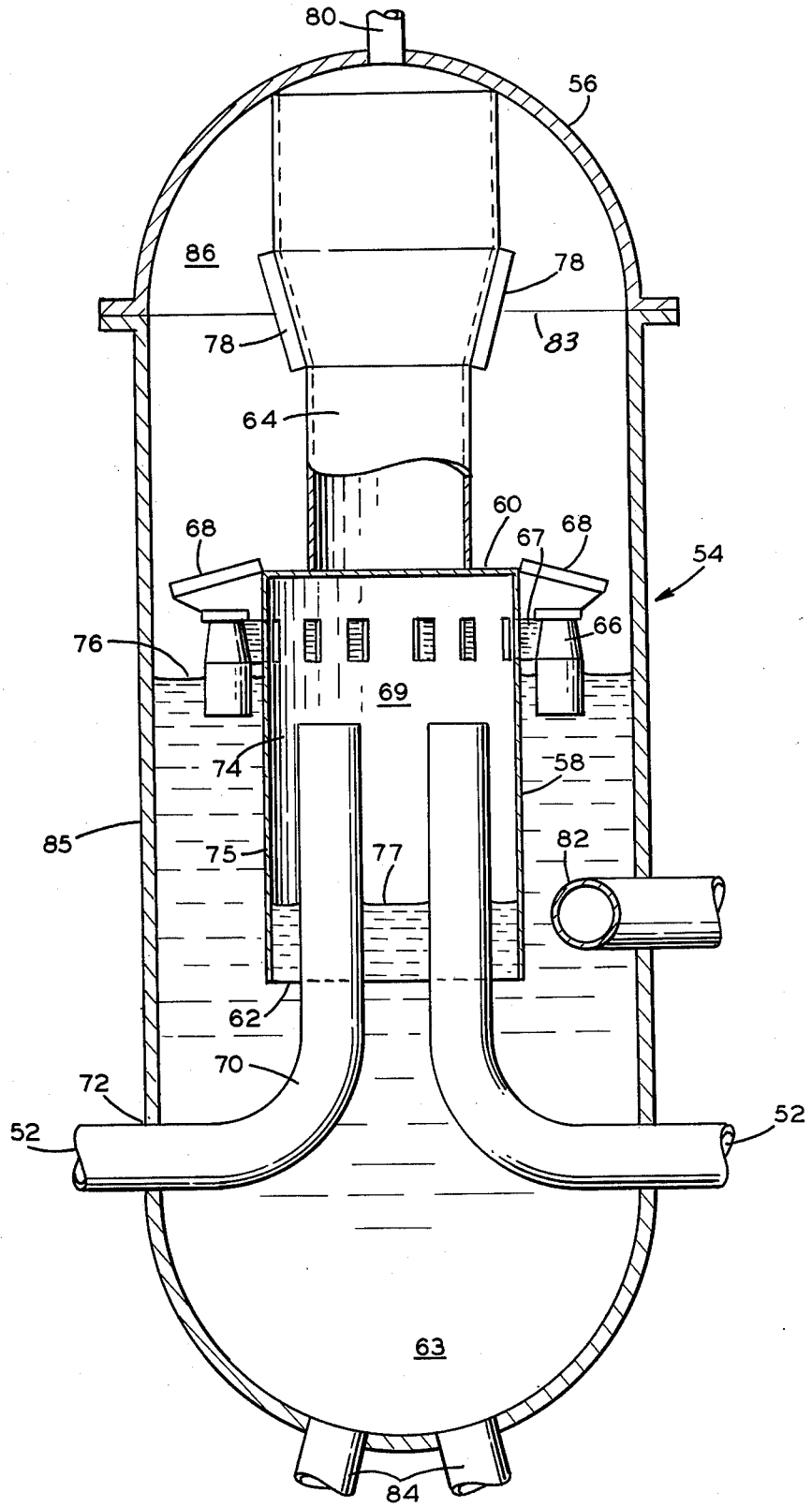
FIG. 2 is an axial cross sectional elevation through an upright cylindrical steam and water drum embodying the invention.

Referring to FIG. 2, a steam generator (not shown) includes steam generating tubes 52 discharging to an upright cylindrical steam and water drum 54 having a removable domed head 56. The drum is provided with a central cylindrical duct 58 extending coaxially of the drum 54 and closed at its upper end 60 and having an open bottom 62 immersed in the water space 63. The duct 58 is supported from a hollow pillar 64 which is secured to the removable head 56. Cyclone type steam and water separators 66 and primary steam driers or scrubbers 68 are mounted at circumferentially spaced intervals around the cylindrical duct 58 with the cyclone separators 66 having their tangential inlets 67 communicating with the interior 69 of the duct 58. The drum inlets 72 which receive the steam generating tubes 52 are connected through extension conduits 70 with an upper portion 74 of the interior 69 of duct 58. In accordance with the invention, the cylindrial wall 75 of duct 58 extends downwardly below the minimum drum water level datum 76 by a vertical distance greater than the difference between the water level 77 within the duct 58 and the water level 76 externally of the duct 58 resulting from the maximum pressure drop through the cyclone separators 66, so that a water seal can be effected.

Secondary steam driers 78 are mounted on the hollow pillar 64 and discharge to the interior thereof which, in turn, communicates with the steam outlet pipe 80. Feedwater is supplied to the drum 54 through a feedwater pipe 82 and water is conveyed to the generating section (not shown) through downcomers 84 extending from the base of the drum.

Removal of the duct 58, the cyclone separators 66, the primary and secondary steam driers 68 and 78 and the hollow pillar 64 is effected through an opening 83 by breaking the seal between the removable head 56 and lifting the head clear of the drum body 85 together with the assembled unit comprised of the duct 58, the cyclone separators 66, the primary and secondary steam driers 68 and 78 and the hollow pillar 64 thereby facilitating inspection, repair or replacement of any one or all of these components.

During operation, the steam and water mixture being discharged through the generating tubes 52 is conveyed through the extension conduits 70 to the duct 58 and through the cyclone separators 66 wherein the steam and water are separated with the steam being discharged through the primary steam driers 68 to the steam space 86 and thence through the secondary steam driers 78 and through the hollow pillar 64 to the steam outlet 80. The water leaving the cyclone separators 66 is discharged to the water space 63 to be recirculated through the downcomers 84.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. A drum including wall means defining an upper vapor space and a lower liquid space, means for supplying a vapor-liquid mixture of the drum, vapor-liquid separating means disposed within the drum and having a vapor outlet communicating with the vapor space and a liquid outlet communicating with the liquid space, the separating means being mounted on a duct extending centrally of the drum, the duct having an open bottom immersed in the liquid space, the liquid surface level externally of the duct being higher than the liquid surface level within the duct due to pressure loss through the separating means, the duct being sized to insure that the vertical distance between the open bottom and the liquid surface level externally of the duct is greater than the difference in liquid surface levels resulting from the maximum pressure loss through the separating means, conduit means connected to the vapor-liquid supply means, the conduit means extending through the open bottom to discharge the vapor-liquid mixture at a location above the liquid surface level within the duct, at least one opening extending through the drum wall means, the opening being sized to allow removal therethrough of the duct with the separating means mounted thereon, and a detachable closure means covering said opening.

2. The drum according to claim 1 including vapor drying means mounted on the duct, and the opening being sized to allow removal therethrough of the duct with said separating means and vapor drying means mounted thereon.

3. The drum according to claim 1 wherein the drum is horizontally disposed and the opening is formed at one end thereof, and including pendent support means located in the vapor space, the support means having sections extending in the direction of the opening, and roller means for removably mounting the duct onto said sections.

4. The drum according to claim 1 wherein the drum is vertically disposed and an upper end portion thereof forms the closure means, and including means for supporting the duct from said closure means.

5. The drum according to claim 4 including vapor outlet means extending through the closure means, a hollow pillar connecting the duct to the closure means and communicating with the vapor outlet means, and vapor drying means mounted on the pillar for discharging vapor through the interior thereof to said vapor outlet means.

* * * * *

UNITED STATES PATENT AND TRADEMARK OFFICE

CERTIFICATE OF CORRECTION

PATENT NO. : 4,077,362

DATED : 3/7/78

INVENTOR(S) : R. J. Hawkins

It is certified that error appears in the above-identified patent and that said Letters Patent are hereby corrected as shown below:

Column 1, line 29 "stream" should read --steam--.

" " line 33 "stream" should read --steam--.

" " line 50 "locaed" should read --located--.

" " line 63 "havin" should read --having--.

Column 2, line 11 "scurbbers" should read --scrubbers--.

" " line 61 "cylindrial" should read --cylindrical--.

Column 3, Claim 1, line 42 "of" should read --to--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*